US012311235B2

(12) United States Patent
Katsurayama et al.

(10) Patent No.: US 12,311,235 B2
(45) Date of Patent: May 27, 2025

(54) BALL FOR BALL GAME

(71) Applicant: Shinji Katsurayama, Nagoya (JP)

(72) Inventors: Shinji Katsurayama, Nagoya (JP); Akio Takagi, Oyama (JP); Hironori Sato, Oyama (JP); Mitsuyoshi Ishikawa, Nagakute (JP); Tatsuki Shimojo, Nagoya (JP)

(73) Assignee: Shinji Katsurayama, Nagoya (JP)

( * ) Notice: Subject to any disclaimer, the term of this patent is extended or adjusted under 35 U.S.C. 154(b) by 0 days.

(21) Appl. No.: 18/566,135

(22) PCT Filed: Jun. 2, 2022

(86) PCT No.: PCT/JP2022/022464

§ 371 (c)(1),
(2) Date: Dec. 1, 2023

(87) PCT Pub. No.: WO2022/255445

PCT Pub. Date: Dec. 8, 2022

(65) Prior Publication Data

US 2024/0278085 A1 Aug. 22, 2024

(30) Foreign Application Priority Data

Jun. 2, 2021 (WO) ..... PCT/JP2021/020979

(51) Int. Cl.
*A63B 43/04* (2006.01)
*A63B 41/00* (2006.01)

(52) U.S. Cl.
CPC ..... *A63B 43/04* (2013.01); *A63B 41/00* (2013.01); *A63B 2041/005* (2013.01)

(58) Field of Classification Search
CPC .... A63B 43/04; A63B 41/00; A63B 2041/005
See application file for complete search history.

(56) References Cited

U.S. PATENT DOCUMENTS 495,863 A * 4/1893 Whitzel ..... A63B 43/00 446/195
2,499,483 A * 3/1950 Foy ..... A63H 5/00 473/594

(Continued)

FOREIGN PATENT DOCUMENTS

CN 110090408 A * 8/2019 ..... A63B 41/00
CN 112057818 A * 12/2020 ..... A63B 43/002

(Continued)

OTHER PUBLICATIONS

International Search Report issued Aug. 9, 2022 in PCT/JP2022/022464 (with English translation), 6 pages.

*Primary Examiner* — Steven B Wong
(74) *Attorney, Agent, or Firm* — Element IP, PLC

(57) ABSTRACT

This ball for ball game includes: a spherical skin portion formed to be transparent at least partially so that inside of an internal space is visible from outside; a tubular retention portion provided in the internal space and extending so as to connect two poles of the skin portion, the tubular retention portion having a surrounded space therein; and a retained object retained in a visible state between the two poles in the surrounded space. The tubular retention portion has a shape helically twisted between the two poles. The tubular retention portion is twisted with an angle not less than 135° and not greater than 270° between the two poles.

8 Claims, 4 Drawing Sheets

(56) References Cited

U.S. PATENT DOCUMENTS

| | | | | | |
|---|---|---|---|---|---|
| 4,609,196 | A * | 9/1986 | Bozinovic | A63B 43/04 | 473/594 |
| 5,161,798 | A * | 11/1992 | Orbanes | A63B 43/00 | 29/899.1 |
| 6,158,390 | A * | 12/2000 | Holtier | A01K 15/025 | 119/702 |
| 7,344,487 | B2 * | 3/2008 | Carter | A63B 21/0552 | 482/142 |
| 7,520,830 | B2 * | 4/2009 | Wong | A63B 43/04 | 473/594 |
| 7,740,551 | B2 * | 6/2010 | Nurnberg | A63B 43/004 | 473/570 |
| 8,029,394 | B2 * | 10/2011 | Burke | A63B 41/02 | 473/594 |
| 2005/0049092 | A1 * | 3/2005 | Lo | A63B 37/0097 | 473/594 |
| 2006/0205547 | A1 * | 9/2006 | O'Neill | A63B 41/04 | 473/604 |
| 2008/0268990 | A1 * | 10/2008 | Todokoro | A63B 41/10 | 473/610 |
| 2011/0251029 | A1 | 10/2011 | Verheem | | |
| 2016/0236043 | A1 * | 8/2016 | Savelli | A63B 43/004 | |

FOREIGN PATENT DOCUMENTS

| | | | | |
|---|---|---|---|---|
| DE | 20004174 | U1 * | 7/2001 | A63B 24/0021 |
| JP | S62-183886 | U | 11/1987 | |
| JP | H09-24128 | A | 1/1997 | |
| JP | 2000061003 | A | 2/2000 | |
| JP | 3119091 | U | 2/2006 | |
| JP | 2015159848 | A | 9/2015 | |
| JP | 2019069083 | A | 5/2019 | |
| JP | 3232650 | U | 7/2021 | |
| KR | 20150089107 | A * | 8/2015 | |
| WO | WO-2005044396 | A2 * | 5/2005 | A63B 41/02 |
| WO | WO-2019100127 | A1 * | 5/2019 | A63H 29/00 |

* cited by examiner

BALL FOR BALL GAME

TECHNICAL FIELD

The present invention relates to a ball for ball game.

BACKGROUND ART

Conventionally, there is known a ball for ball game used in a sport of a soccer ball, a volleyball, etc., or practice thereof (see, for example, Patent Literature 1). A ball for ball game described in Patent Literature 1 is formed to be transparent, so that the vicinity of the center is visible in a see-through way from outside. This transparent ball has, therein, an indication arrow indicating a target direction in which the ball is to be carried and an indication arrow indicating a direction in which the ball is to be rotated.

CITATION LIST

Patent Literature

Patent Literature 1: JP2015-159848 (A)

SUMMARY OF INVENTION

Technical Problem

Here, in order to improve a ball control technique of a player, making the player conscious of a sphere center as the center of gravity of the ball with respect to the center of gravity of the player's body is important. For making the player conscious of the sphere center of the ball, providing a center object visible to the player at the sphere center of the ball is effective, and a structure for retaining the center object in an internal space of the ball is needed.

In general, a no-spin ball is accurately produced by performing a hit at the sphere center of a ball, and a ball shot (hereinafter, referred to as changing ball) such as a curveball is accurately produced by performing a hit at a position shifted from the sphere center. Therefore, if the center object is kept in a state of being retained at the sphere center of the ball, making a player practice performing a hit toward the sphere center or a position shifted from the sphere center while being conscious of the sphere center using the center object contributes to effective practice for improving the ball control technique.

In order to enhance the ball control technique for each type of shot to be performed, clearly grasping a ball control position (hitting point) through visual recognition is further important. In particular, in order to indicate a position shifted from the sphere center, a structure that allows the center object to move in the radial direction from the sphere center is desired. If the center object of the ball is allowed to be intentionally shifted in the radial direction from the sphere center for the purpose of performing a hit for producing a changing ball, this enables a player to be clearly conscious of a position at which a hit for producing a changing ball is to be performed, through visual recognition, and making a player practice performing a hit toward a position shifted from the sphere center contributes to improvement in a technique for producing a changing ball.

In order to make a player gain a high-level ball control technique, letting the player use a ball in a state in which the player's body is not tensed up inappropriately (i.e., a relaxed state) is important, and means for clearly determining whether or not a force is appropriately applied to the ball is desired. As this means, a structure that allows the center object to move in the radial direction from the sphere center by a hit is effective. That is, this structure allows a player to, each time the player hits the ball, confirm the position of the center object after hitting the ball. In this structure, if setting is made such that, when the magnitude of a force applied to the ball by the player is appropriate, the center object does not move, and when the force is inappropriate, the center object moves, the player is allowed to clearly grasp the degree of force application to the ball through visual recognition.

However, if a retention structure for retaining the center object is a rigid structure having a support bar or the like for fixing the center object at the sphere center with respect to a skin portion, the center object is not movable in the radial direction from the sphere center, so that there is limitation in improving the ball control technique.

The present invention has been made in view of the above circumstances, and an object of the present invention is to provide a ball for ball game in which a retained object as a center object is retained in the vicinity of a sphere center in an internal space and also is easily movable in the radial direction so as to be eccentric.

Solution to Problem

One aspect of the present invention is a ball for ball game including: a spherical skin portion formed to be transparent at least partially so that inside of an internal space is visible from outside; a tubular retention portion provided in the internal space and extending so as to connect two poles of the skin portion, the tubular retention portion having a surrounded space therein; and a retained object retained in a visible state between the two poles in the surrounded space. The tubular retention portion has a shape helically twisted between the two poles.

In this configuration, by a tubular retention portion helically twisted between the two poles of the skin portion, the retained object is retained in the vicinity of the sphere center in the surrounded space and also is easily movable in the radial direction so as to be eccentric.

DESCRIPTION OF EMBODIMENTS

Hereinafter, specific embodiments of a ball for ball game of the present invention will be described with reference to the drawings.

1. Configuration of Ball for Ball Game

A ball 1 for ball game of the present embodiment is, for example, a soccer ball, a volleyball, a basketball, a golf ball, a ball for baseball, or a tennis ball, and is a spherical ball used for sport or practice. The ball 1 for ball game is a transparent ball that allows a retained object in the vicinity of the sphere center to be viewed through a skin formed to be transparent. The ball 1 for ball game is used in a state in which high-pressure air is sealed in the internal space.

Figure 1:
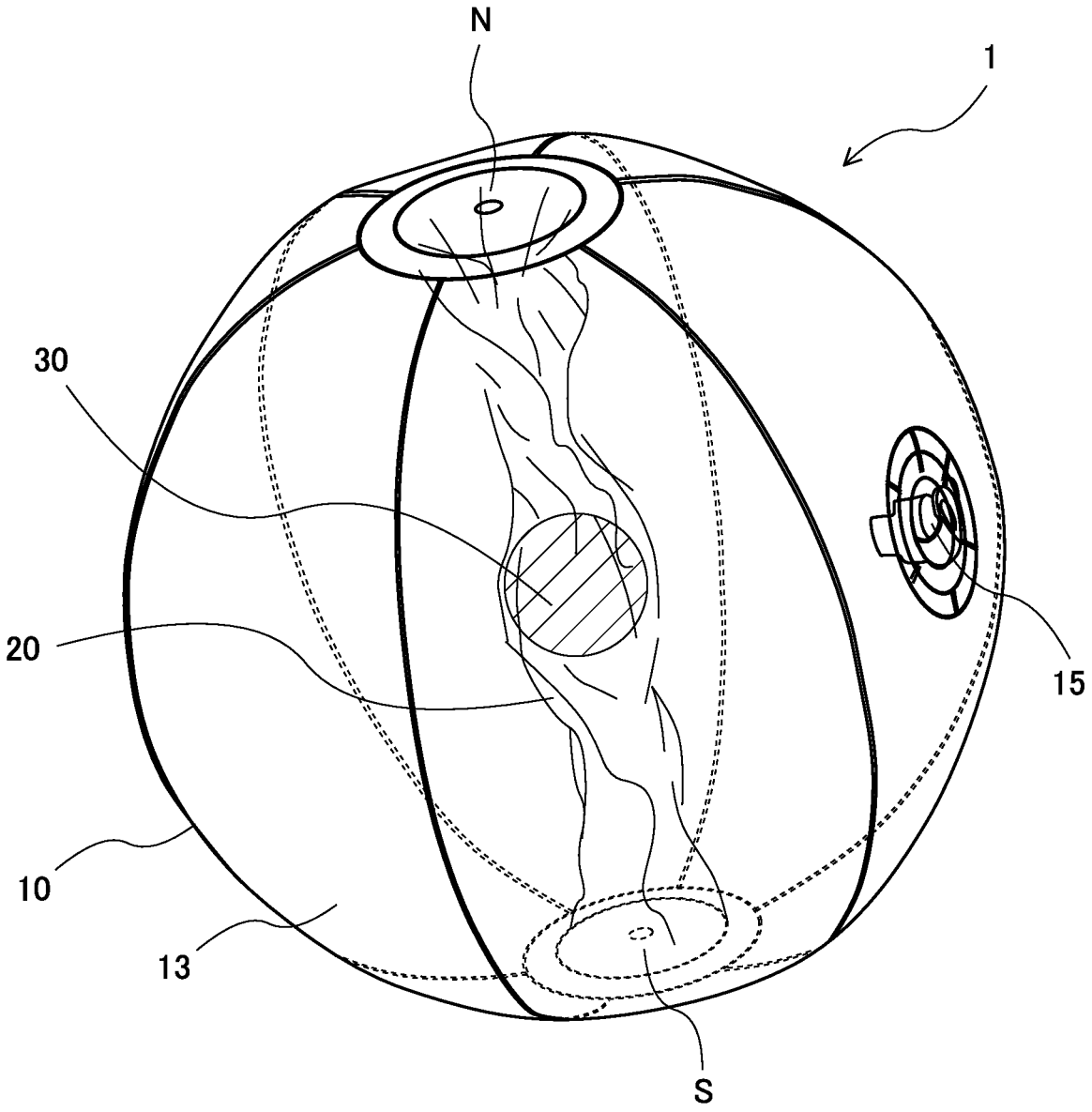
FIG. 1 is a perspective view of a ball for ball game according to an embodiment of the present invention.
Figure 2:
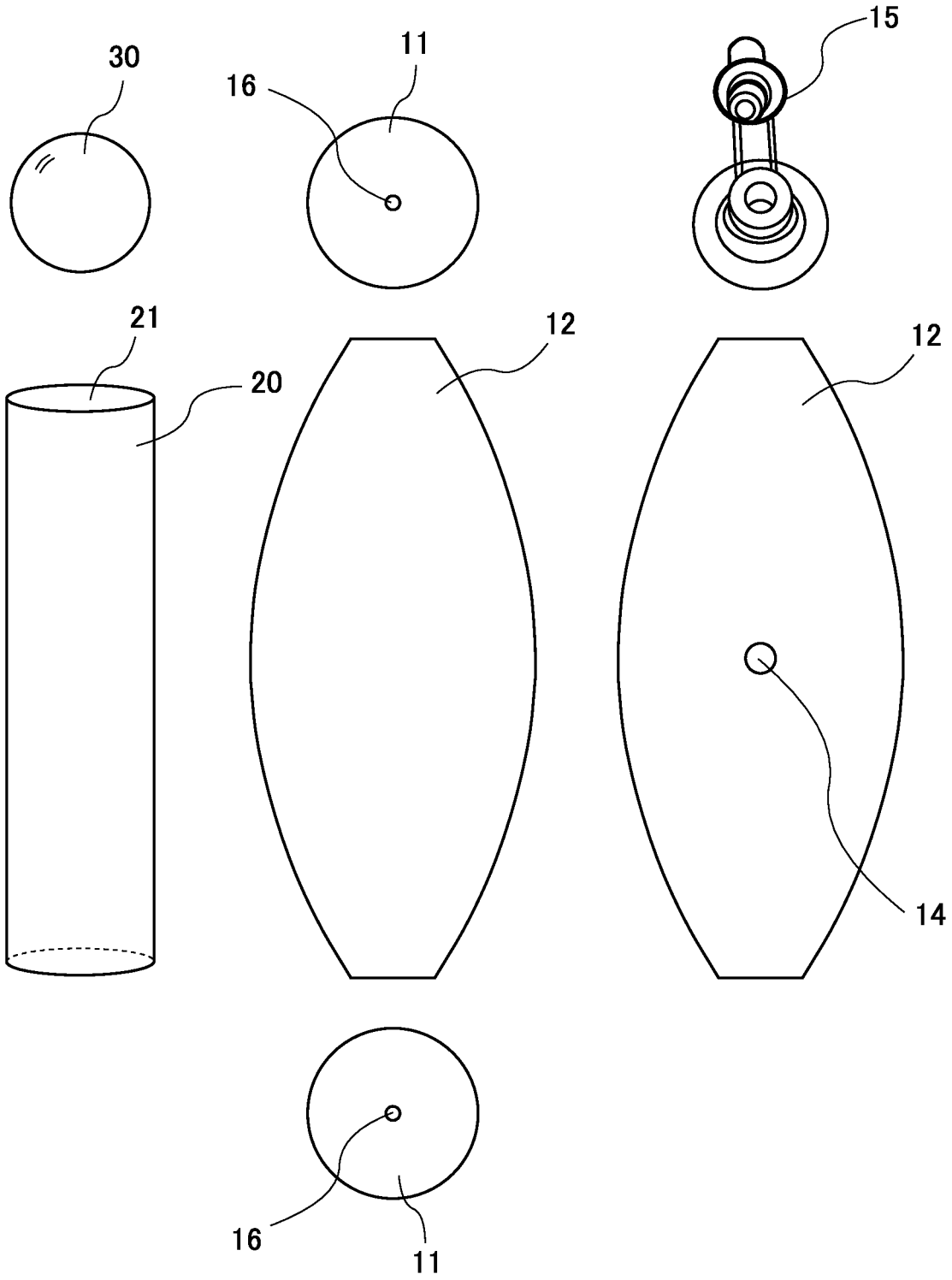
FIG. 2 is an exploded view of the ball for ball game of the embodiment (regarding a plurality of boat-shaped members having the same shape, only two boat-shaped members, one not having an air hole and one having an air hole, are shown)

As shown in FIG. 1 and FIG. 2, the ball 1 for ball game includes a skin portion 10, a tubular retention portion 20, and a retained object 30.

The skin portion 10 is a part forming a spherical skin of the ball 1 for ball game. The skin portion 10 is made of a flexible material such as polyvinyl chloride, for example. The skin portion 10 is formed to be transparent at least partially so that inside of the internal space (in particular, the vicinity of the sphere center) is visible from outside. The skin portion 10 is made of a transparent or translucent material. The skin portion 10 is formed by a plurality of members being compression-bonded by heat or the like. The skin portion 10 is formed of circular pole members 11 and boat-shaped members 12.

The circular pole members 11 are members located at two opposite poles N, S of the ball 1 for ball game. Each circular pole member 11 is formed in a circular shape. Two circular pole members 11 are provided correspondingly to the poles N, S. The boat-shaped members 12 are members forming parts other than the poles N, S of the ball 1 for ball game. Each boat-shaped member 12 is formed in a boat shape. A plurality of (for example, six) boat-shaped members 12 are provided so as to be arranged around an axis connecting the two poles N, S. Each boat-shaped member 12 contacts with outer side lines (specifically, axial-direction center parts of the outer side lines) of the boat-shaped members 12 adjacent in the circumferential direction, and contacts with parts of the outer circumferences of the circular pole members 11.

The skin portion 10 of the ball 1 for ball game is formed by the plurality of boat-shaped members 12 and the circular pole members 11 at both poles N, S being compression-bonded in a state of contacting with each other at the outer side lines. When the skin portion 10 is formed, an internal space 13 enclosed by the skin portion 10 is formed in the skin portion 10.

The skin portion 10 has an air hole 14 and a closure plug 15. The air hole 14 is a hole through which outside air to be introduced into the internal space 13 and inside air to be discharged from the internal space 13 to outside are passed. The air hole 14 is provided at one of the plurality of boat-shaped members 12. That is, the air hole 14 is provided at a part different from the two poles N, S where the circular pole members 11 are located, of the skin portion 10. Specifically, the air hole 14 is formed in the vicinity of the middle between two contact ends of the boat-shaped member 12 with which the two circular pole members 11 contact, i.e., in the vicinity of the middle in the axial direction.

The closure plug 15 is a part for closing the air hole 14. The closure plug 15 is attached around the air hole 14 on the boat-shaped member 12. The closure plug 15 is attachable/detachable to/from the air hole 14. When the air hole 14 is closed by the closure plug 15, the internal space 13 is closed. Thus, the ball 1 for ball game is kept in a state in which air is sealed in the internal space 13. Then, when high-pressure air is sealed in the internal space 13, the internal space 13, i.e., the skin portion 10 and therefore the ball 1 for ball game are formed in a spherical shape.

The tubular retention portion 20 is a part for retaining the retained object 30. The tubular retention portion 20 is formed using a cylindrical-shaped member, and forms a surrounded space 21. The tubular retention portion 20 is formed to extend in the axial direction so as to connect the two poles N, S. The surrounded space 21 surrounds and retains the retained object 30. The tubular retention portion 20 is made of a flexible material such as polyvinyl chloride, for example, so as to be changeable in shape. The tubular retention portion 20 may be formed by cloth or paper as long as the retained object 30 is surrounded and retained. The tubular retention portion 20 is formed to be transparent at least partially so that the inside of the surrounded space 21 (in particular, the vicinity of the sphere center) is visible from outside. The tubular retention portion 20 is made of a transparent or translucent material.

The tubular retention portion 20 may be made of a stretchable material having elasticity as long as the retained object 30 is retained. The tubular retention portion 20 may be kept having a comparatively small diameter in a state in which the retained object 30 is not inserted in the surrounded space 21, and may stretch outward in the radial direction in a state in which the retained object 30 is inserted in the surrounded space 21. Also, the tubular retention portion 20 may be helically twistable.

The tubular retention portion 20 may be formed in a cylindrical shape by rounding one sheet-shaped rectangular member and then compression-bonding the circumferential-direction ends thereof to each other, or by connecting a plurality of sheet-shaped rectangular members in the circumferential direction and then compression-bonding the sheet-shaped rectangular members, for example. As shown in FIG. 2, in a state in which the tubular retention portion 20 is not helically twisted between the two poles N, S in the internal space 13 of the skin portion 10, the tubular retention portion 20 has such a cylindrical shape that a diameter (specifically, the inner diameter of the tubular retention portion 20) R1 of the surrounded space 21 is constant without changing irrespective of axial-direction positions. The diameter R1 of the surrounded space 21 is a diameter in a basic shape of the tubular retention portion 20 that has not been twisted between the two poles N, S.

The tubular retention portion 20 is formed so as to allow the retained object 30 to move in the axial direction in the surrounded space 21. Specifically, the tubular retention portion 20 is formed such that the diameter R1 of the surrounded space 21 is not less than an outer diameter Rb of the retained object 30 (preferably, is greater than the outer diameter Rb) (see FIG. 3). The retained object 30 is movable in the surrounded space 21 in not only a state in which the tubular retention portion 20 is not twisted between the two poles N, S but also a state in which the tubular retention portion 20 is twisted. The tubular retention portion 20 is opened at tube ends on both sides so as to allow the retained object 30 to be inserted into the surrounded space 21 from each tube end.

The tubular retention portion 20 is placed in the internal space 13 of the skin portion 10. The tubular retention portion 20 is provided in the internal space 13 and extends so as to connect the two poles N, S of the skin portion 10. The tubular retention portion 20 is formed as a part of the ball 1 for ball game by edges of the tube ends on both sides being compression-bonded to inner surfaces in the vicinities of joining parts between the circular pole members 11 and the boat-shaped members 12 of the skin portion 10. The internal space 13 of the skin portion 10 and the surrounded space 21 of the tubular retention portion 20 are separated from each other without communicating with each other.

Figure 3:
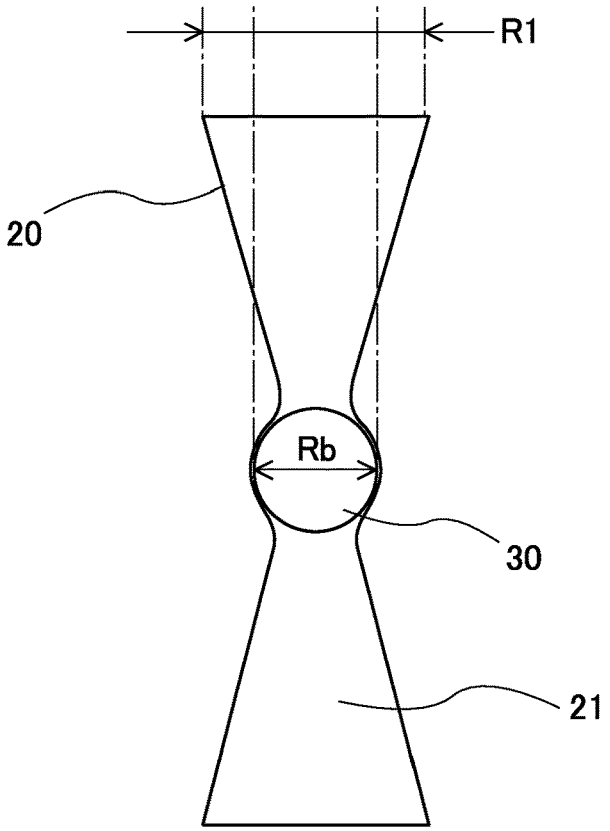
FIG. 3 schematically shows a relationship between a tubular retention portion and a retained object, and a structure for retaining the retained object at the sphere center, in the ball for ball game of the embodiment.

The tubular retention portion 20 surrounds and retains the retained object 30 in a visible state in the vicinity of the center between the two poles N, S of the skin portion 10, in the surrounded space 21. The tubular retention portion 20 is compression-bonded to inner surfaces in the vicinities of the joining parts between the circular pole members 11 and the boat-shaped members 12, in a state in which the tubular retention portion 20 is helically twisted between the two poles N, S of the skin portion 10. After the ball 1 for ball game is manufactured, the tubular retention portion 20 has a shape helically twisted between the two poles N, S of the skin portion 10, as shown in FIG. 1 and FIG. 3.

The twist angle of the tubular retention portion 20 is set at such an angle that the tubular retention portion 20 covers substantially the entire surface of the retained object 30 between the two poles N, S. In addition, the above twist angle is set at such an angle that, when the ball 1 for ball game is used in a state in which the air pressure in the internal space 13 is not lower than a predetermined value, the retained object 30 is retained between the two poles N, S of the skin portion 10 (in particular, in the vicinity of the center of a connection line between the two poles N, S) in the surrounded space 21 and is inhibited from moving in the radial direction, and when the air pressure of the internal space 13 is lower than the predetermined value, the retained object 30 in the surrounded space 21 is allowed to be moved in the radial direction by a force of a human hand. Further, the above twist angle is set at such an angle that the durability until the tubular retention portion 20 is damaged due to usage of the ball 1 for ball game, i.e., due to vibration of the retained object 30 in the surrounded space 21, is kept high.

The above twist angle between the two poles N, S is preferably not less than 135° and not greater than 270°, and more preferably not less than 135° and not greater than 225°. In particular, for the purpose of improving the durability of the tubular retention portion 20, the twist angle is preferably around 180°.

Here, in ball games, letting a player use the ball 1 for ball game while being relaxed with the body loosened is important for improving the ball control technique. That is, if the degree of force application is inappropriate when a player hits the ball 1 for ball game, the player has difficulty in performing ball control. Even when the ball 1 for ball game is hit with the same magnitude of force, ease of movement of the retained object 30 in the surrounded space 21 changes depending on the twist angle. Specifically, when the twist angle is small, the movement easily occurs, and when the twist angle is great, the movement hardly occurs.

Accordingly, the above twist angle is set at such a boundary value that, when the ball 1 for ball game is used in a state in which the air pressure in the internal space 13 is in an appropriate predetermined range, and the ball 1 for ball game is hit with an appropriate magnitude of force, the retained object 30 in the surrounded space 21 hardly moves in the radial direction, and when the ball 1 for ball game is hit with a force greater than the appropriate force, the retained object 30 in the surrounded space 21 moves in the radial direction. With such a setting of the twist angle, when the ball 1 for ball game is hit with a force greater than the appropriate force, the retained object 30 in the surrounded space 21 moves in the radial direction. Thus, by confirming the position of the retained object 30 in the surrounded space 21 after a player has used the ball 1 for ball game, the player finds whether or not the hitting of the ball 1 for ball game by the player has been performed with an appropriate force.

The retained object 30 is a member placed in the vicinity of the sphere center of the ball 1 for ball game, in the internal space 13. The retained object 30 is retained in a visible state between the two poles N, S in the surrounded space 21 of the tubular retention portion 20. The retained object 30 may have a spherical shape so as to be easily movable in the surrounded space 21, or conversely, may have a rectangular parallelepiped shape or a doll shape similar to a human, an animal, or the like, so as to be hardly movable in the surrounded space 21, for example.

The retained object 30 is formed to be visible from outside of the ball 1 for ball game by a player who plays with the ball 1 for ball game. For example, the retained object 30 is preferably colored with a red color, a fluorescent color, or the like. The retained object 30 is made of a material such as cork, synthetic resin, or plastic, for example. The retained object 30 may be a hollow structure made of a plastic material, like a ping pong ball, or may be a rubber tube to be filled with air therein, for example.

Figure 4:
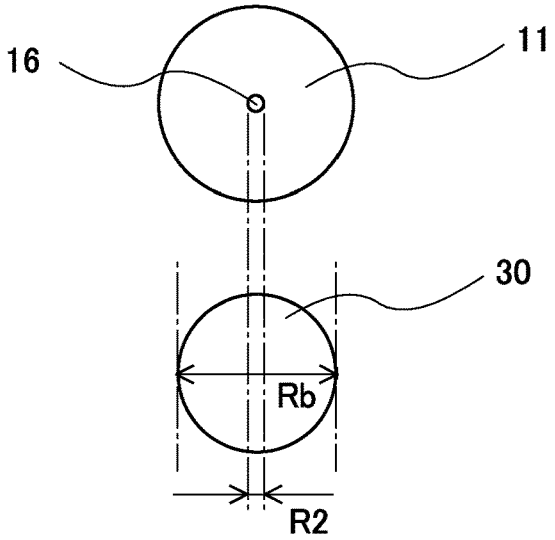
FIG. 4 shows a relationship between the retained object and a communication hole of a skin portion in the ball for ball game of the embodiment.

The skin portion 10 has communication holes 16. The communication holes 16 are holes through which the surrounded space 21 of the tubular retention portion 20 communicates with outside air. The communication holes 16 are provided to the circular pole members 11 at the two poles N, S, respectively. Each communication hole 16 may be formed at the center of the circular pole member 11, or at a position shifted from the center. The communication hole 16 has a diameter R2 smaller than the outer diameter Rb of the retained object 30, as shown in FIG. 4.

The communication holes 16 have a function of letting air in/out between the surrounded space 21 and outside air when the retained object 30 moves in the surrounded space 21, while preventing the retained object 30 from going out from the surrounded space 21 of the tubular retention portion 20. In addition, when the tubular retention portion 20 is twisted between the two poles N, S at a stage of manufacturing the ball 1 for ball game, the communication holes 16 have a function of causing the twist without an extreme bias at axial-direction positions between the poles N and S, as compared to a structure in which the communication holes 16 are not provided to the skin portion 10.

2. Advantageous Effects of Ball for Ball Game

In the ball 1 for ball game having the above configuration, the retained object 30 is surrounded and retained in the surrounded space 21 of the tubular retention portion 20. The retention of the retained object 30 is realized by the tubular retention portion 20 being helically twisted between the two poles N, S of the skin portion 10 so as to contact with the surface of the retained object 30 substantially uniformly. In a case where, for example, the retained object 30 is placed in the vicinity of the center of a line connecting the two poles N, S of the skin portion 10, the retained object 30 is visible in the vicinity of the center between the two poles N, S of the skin portion 10 from outside of the ball 1 for ball game, in a state in which the retained object 30 is retained in the surrounded space 21.

A player is allowed to use the ball 1 for ball game while viewing, through the skin portion 10 and the tubular retention portion 20, the retained object 30 retained in the vicinity of the sphere center by the tubular retention portion 20. Thus, the ball 1 for ball game allows the player who uses the ball 1 for ball game to view the retained object 30 placed in the vicinity of the sphere center, through the skin portion 10 and the tubular retention portion 20 which are transparent, from outside of the ball 1 for ball game, thereby allowing the player to use the ball while being conscious of the sphere center.

In a case of a soccer ball having a general hardness, frequent heading by a player may lead to a physical disability or the like. In contrast, in a case where the ball 1 for ball game is used for heading practice in soccer, ball control practice is performed with a material having high safety for heading while a player is conscious of the sphere center, thus enabling improvement in the ball control technique while ensuring high safety for the player.

If high-pressure air not lower than a predetermined value is sealed in the internal space 13 of the skin portion 10, the ball 1 for ball game is used as a ball by a player. In addition, as described above, the internal space 13 of the skin portion 10 and the surrounded space 21 of the tubular retention portion 20 are separated from each other without communicating with each other. Therefore, when the high-pressure air is sealed in the internal space 13, the high-pressure air does not flow from the internal space 13 into the surrounded space 21 of the tubular retention portion 20. Meanwhile, the surrounded space 21 always communicates with outside via the communication holes 16. Thus, the high-pressure air in the internal space 13 is prevented from leaking from the surrounded space 21 to outside.

In the above structure, when the high-pressure air is not sealed in the internal space 13, the tubular retention portion 20 is kept in a state of being helically twisted between the two poles N, S of the skin portion 10. In addition, when the high-pressure air is sealed in the internal space 13, the outer surface of the tubular retention portion 20 is exposed to the high-pressure air in the internal space 13 evenly over the entire circumference, and the inner surface of the tubular retention portion 20 is exposed to atmospheric-pressure air in the surrounded space 21 evenly over the entire circumference. In this case, the tubular retention portion 20 is kept in a state of being helically twisted between the two poles N, S, without being deformed. Therefore, irrespective of whether or not the high-pressure air is sealed in the internal space 13, the tubular retention portion 20 is kept in a state of being helically twisted between the two poles N, S of the skin portion 10.

With the structure of the tubular retention portion 20, when the high-pressure air not lower than the predetermined value is sealed in the internal space 13, the retained object 30 is retained in a state of being hardly movable in the radial direction in the surrounded space 21 owing to the twisted state of the tubular retention portion 20. In addition, when the high-pressure air not lower than the predetermined value is not sealed in the internal space 13, the retained object 30 is easily movable in the radial direction from the sphere center of the skin portion 10 in the surrounded space 21, by a human's hand from outside of the skin portion 10, in a state in which air is removed from the internal space 13 and the inner surface of the skin portion 10 is close to the outer surface of the tubular retention portion 20.

In the ball 1 for ball game, when the high-pressure air is not sealed in the internal space 13, the retained object 30 is movable along the radial direction in the surrounded space 21 by a human's hand from the outer side of the skin portion 10, while being retained in the surrounded space 21 of the tubular retention portion 20. Then, in the ball 1 for ball game, when the high-pressure air is sealed in the internal space 13 in a state in which the retained object 30 has been moved in the radial direction from the sphere center, the retained object 30 is visible from outside while being kept in an eccentric state of being shifted from the sphere center. In this case, the ball 1 for ball game is used by a player in a state in which the retained object 30 is in an eccentric state, and using the ball 1 for ball game in this state provides an irregular behavior during usage of the ball 1 for ball game by the player.

Thus, with the ball 1 for ball game, the retained object 30 is easily retained in the vicinity of the sphere center in the internal space 13 of the skin portion 10 while being allowed to be eccentric, and the retained object 30 in the surrounded space 21 is visible to a player so that a behavior to be provided to the ball 1 for ball game in accordance with the position of the retained object 30 is easily conveyed to the player.

The tubular retention portion 20 which is helically twisted between the two poles N, S of the skin portion 10 in the internal space 13 of the skin portion 10, extends so as to connect the two poles N, S. This allows a player to recognize the tubular retention portion 20 as an axis connecting the two poles N, S of the ball 1 for ball game, so that the ball 1 for ball game is easily used by the player.

The twist angle of the tubular retention portion 20 is set at such a boundary angle that, when the ball 1 for ball game is hit with an appropriate magnitude of force, the retained object 30 in the surrounded space 21 hardly moves in the radial direction, and when the ball 1 for ball game is hit with a force greater than the appropriate force, the retained object 30 in the surrounded space 21 moves in the radial direction, as described above. With this configuration, if hitting of the ball 1 for ball game is performed with an appropriate magnitude of force, the retained object 30 in the surrounded space 21 does not move in the radial direction, and if hitting of the ball 1 for ball game is performed with a force greater than the appropriate magnitude of force, the retained object 30 in the surrounded space 21 moves in the radial direction.

Thus, by confirming the position of the retained object 30 in the surrounded space 21 after a player uses the ball 1 for ball game at each time, the player finds whether or not the player has hit the ball 1 for ball game with a force greater than the appropriate force, afterward. Therefore, the ball 1 for ball game allows the player to practice learning the degree of force application to the ball 1 for ball game, i.e., practice using the ball 1 for ball game with an appropriate force, thus contributing to improvement in the ball control technique.

If the ball 1 for ball game is used in a state in which the retained object 30 is retained at the sphere center in the surrounded space 21, a player is allowed to practice performing a hit toward the sphere center or a position shifted from the sphere center while being conscious of the sphere center by the retained object 30, thus contributing to efficient practice for improving the ball control technique. Meanwhile, if the ball 1 for ball game is used in a state in which the retained object 30 is intentionally shifted from the sphere center in the surrounded space 21, a player becomes conscious of the position shifted from the sphere center as a position at which a hit for producing a changing ball is to be performed, by the retained object 30, and making the player practice performing a hit toward the shifted position contributes to improvement in the changing ball.

The twist angle of the tubular retention portion 20 between the two poles N, S is not less than 135° and not greater than 270°. In particular, a structure in which the twist angle is around 180° improves the durability of the tubular retention portion 20 against usage of the ball 1 for ball game, as compared to a structure having another twist angle.

The surrounded space 21 of the tubular retention portion 20 communicates with outside air via the communication holes 16 provided to the circular pole members 11 of the skin portion 10. With this structure, when the retained object 30 is moved in the radial direction in the surrounded space 21 by a human's hand, air is let in/out between the surrounded space 21 and outside air. Thus, unlike a structure not having the communication holes 16, the above structure prevents such a phenomenon that the internal pressure is biased between spaces on both sides of the retained object 30 in the surrounded space 21 during the movement, specifically, that the pressure in a space on a side to which the retained object 30 is moved with respect to the retained object 30 in the surrounded space 21 becomes high and the pressure in a space on the opposite side becomes low, thus facilitating movement of the retained object 30 in the radial direction.

In the structure of the surrounded space 21 provided with the communication holes 16, when the tubular retention portion 20 is twisted between the two poles N, S at a stage of manufacturing the ball 1 for ball game, the twist is produced without an extreme bias at axial-direction positions between the poles N and S, as compared to a structure in which the communication holes 16 are not provided to the skin portion 10. Thus, the function of retaining the retained object 30 by the tubular retention portion 20 is sufficiently exerted.

3. Modifications

In the above embodiment, the communication holes 16 are provided to the respective circular pole members 11 located at the two poles N, S of the skin portion 10. However, the present invention is not limited thereto. As long as air is let in/out between the surrounded space 21 and outside air, the communication hole 16 may be provided to only one of the circular pole members 11 located at the two poles N, S.

In the above embodiment, the tubular retention portion 20 extends so as to connect the two poles N, S at which the circular pole members 11 are located, of the skin portion 10. However, the present invention is not limited thereto. The tubular retention portion 20 may extend so as to connect two poles (the two poles are provided to the boat-shaped members 12) other than the two poles N, S at which the circular pole members 11 are located, of the skin portion 10. According to this modification, a part where the circular pole member 11 and the boat-shaped member 12 are compression-bonded and a part where the boat-shaped member 12 and the tubular retention portion 20 are compression-bonded, of the skin portion 10, are separated away from each other without being close to each other, thus preventing reduction in rigidity of the ball 1 for ball game.

In the above embodiment, on the skin portion 10, the two poles N, S at which the circular pole members 11 are located and both ends of the tubular retention portion 20 are compression-bonded are set at such positions that a line connecting the two poles N, S passes through the sphere center, and the tubular retention portion 20 extends so as to pass through the sphere center and connect the two poles N, S by a straight line. However, the present invention is not limited thereto. On the skin portion 10, two poles at which both ends of the tubular retention portion 20 are compression-bonded may be set at such positions that a line connecting the two poles does not pass through the sphere center. In this case, the tubular retention portion 20 preferably extends so as to pass through the sphere center and connect the two poles by a curved line or a bent line. In this modification, in order that a part of the tubular retention portion 20 in the vicinity of the sphere center is fixed so as to be prevented from moving in the internal space 13, a support member connecting the tubular retention portion 20 and the skin portion 10 (specifically, the inner surface of the skin portion 10) is preferably provided.

In the above embodiment, the ball 1 for ball game includes the tubular retention portion 20 for retaining the retained object 30, and the tubular retention portion 20 is formed using a cylindrical-shaped member. However, the present invention is not limited thereto. The tubular retention portion 20 may be formed using a polygonal-tube-shaped member such as a quadrangular-tube-shaped member.

In the above embodiment, the internal space 13 of the skin portion 10 and the surrounded space 21 of the tubular retention portion 20 are separated from each other without communicating with each other. However, the present invention is not limited thereto. The internal space 13 of the skin portion 10 and the surrounded space 21 of the tubular retention portion 20 may communicate with each other. In the structure of this modification, in order to prevent air from being removed from the internal space 13 to outside via the surrounded space 21, the circular pole members 11 need to have no communication holes 16.

Figure 5:
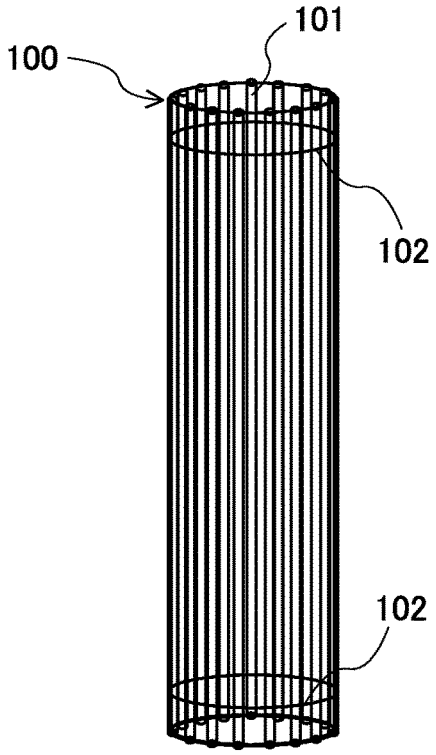
FIG. 5 shows a spatial structure of a tubular retention portion included in a ball for ball game according to a first modification of the present invention, in a non-twisted state.

In this modification, as shown in FIG. 5, the ball 1 for ball game may include a tubular retention portion 100 for retaining the retained object 30, and the tubular retention portion 100 is formed in a tubular shape as a whole by arranging bar-shaped members 101 such as round or square bars in the circumferential direction of a circle or the like. The tubular retention portion 100 may be formed such that the members 101 are arranged with gaps therebetween in the circumferential direction (the gaps are smaller than the outer diameter Rb of the retained object 30 so as to prevent the retained object 30 from passing through the gap) and are joined to tubular band-shaped members 102 at axial-direction ends, and the tubular retention portion 100 is compression-bonded to the skin portion 10 side, in a twisted state.

Figure 6:
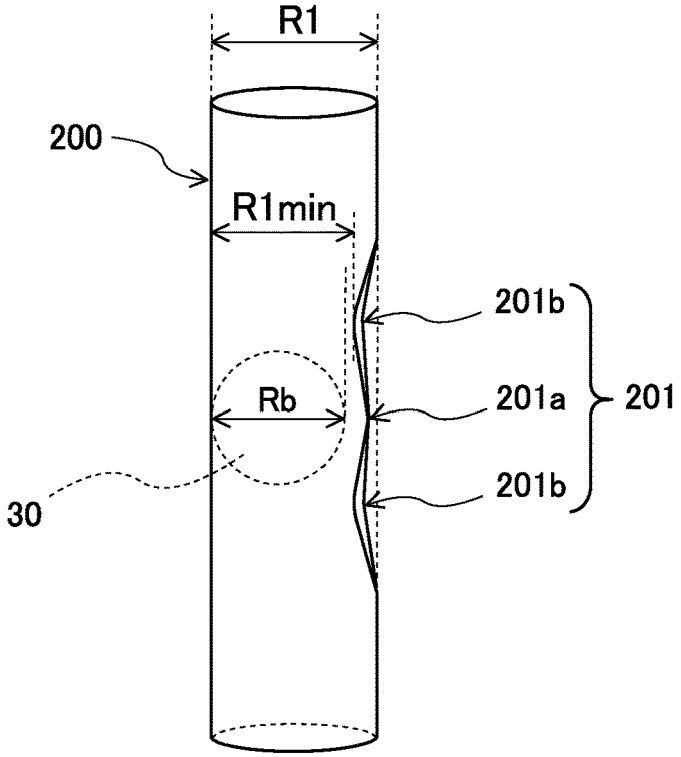
FIG. 6 shows a spatial structure of a tubular retention portion included in a ball for ball game according to a second modification of the present invention, in a non-twisted state.

In the above embodiment, the tubular retention portion 20 in a state of not being helically twisted between the two poles N, S has such a cylindrical shape that the diameter R1 of the surrounded space 21 is constant without changing irrespective of axial-direction positions. However, the present invention is not limited thereto. As shown in FIG. 6, the ball 1 for ball game may include a tubular retention portion 200 for retaining the retained object 30, and the tubular retention portion 200 in a state of not being helically twisted between the two poles N, S may have such a tubular shape that the diameter R1 of the surrounded space 21 changes in accordance with axial-direction positions.

In the above modification, the tubular retention portion 200 is formed such that the retained object 30 is movable in the axial direction in the surrounded space 21. The tubular retention portion 200 has a recess-protrusion portion 201. The recess-protrusion portion 201 is a part where the diameter R1 of the surrounded space 21 changes in accordance with axial-direction positions. The recess-protrusion portion 201 has such a shape that the inner surface of the tubular retention portion 200 is along the outer surface of the retained object 30, thus facilitating retention of the retained object 30.

The recess-protrusion portion 201 has a protrusion 201*a* protruding outward in the radial direction and a recess 201*b* recessed inward in the radial direction relative to the protrusion 201*a*. The protrusion 201*a* and the recess 201*b* are arranged continuously in the axial direction. The inner diameter of the tubular retention portion 200, i.e., the minimum diameter of the diameter R1 of the surrounded space 21 (specifically, the inner diameter of the recess 201*b*)

R1min is not less than the outer diameter Rb of the retained object 30. The retained object 30 is movable in the surrounded space 21 in not only a state in which the tubular retention portion 200 is not twisted between the two poles N, S but also a state in which the tubular retention portion 200 is twisted.

The protrusion 201*a* and the recess 201*b* may be formed in such a shape that facilitates determination for whether or not a force from a player has been appropriately applied to the ball 1 for ball game after hitting, for the purpose of improving the ball control technique. The protrusion 201*a* and the recess 201*b* may have slope surfaces extending while being sloped relative to the axial direction. The top of the protrusion 201*a* and the bottom of the recess 201*b* may be formed in sharply angled shapes or gradual shapes. The angle formed by the top of the protrusion 201*a* and the angle formed by the bottom of the recess 201*b* are preferably adjusted to optimum angles for determining whether or not a force from a player has been appropriately applied to the ball 1 for ball game after hitting, for the purpose of improving the ball control technique.

In the structure of this modification, the retained object 30 is movable in the axial direction in the surrounded space 21 of the tubular retention portion 200. In addition, since the retained object 30 is easily retained by the recess-protrusion portion 201 in the surrounded space 21 of the tubular retention portion 200, the ball 1 for ball game in which the retained object 30 hardly moves in the radial direction and further in the axial direction also during player's practice, is obtained. Further, by confirming the position of the retained object 30 in the surrounded space 21 after hitting of the ball 1 for ball game by a player through visual recognition, the player easily determines whether a force from the player has been appropriately applied.

The recess-protrusion portion 201 may have such a structure that, for example, as shown in FIG. 6, one protrusion 201*a* is formed in the vicinity of the axial-direction center and two recesses 201*b* are formed with the one protrusion 201*a* interposed therebetween in the axial direction. With this structure, since the retained object 30 is easily retained in the vicinity of the axial-direction center of the surrounded space 21, i.e., in the vicinity of the sphere center, the ball 1 for ball game that allows a player to use the ball 1 for ball game while being conscious of the sphere center, is obtained.

The recess-protrusion portion 201 may have such a structure that the protrusion 201*a* is formed at a position shifted to the axial-direction end, instead of being formed in the vicinity of the axial-direction center as described above. The recess-protrusion portion 201 may have such a structure that two or more protrusions 201*a* are formed separately from each other in the axial direction and the recesses 201*b* may be formed on both sides in the axial direction of each protrusion 201*a*. The recess-protrusion portion 201 may be formed only at a part of the entire circumference of the tube of the tubular retention portion 200 as shown in FIG. 6, or may be formed over the entire circumference. The recess-protrusion portion 201 may be helically formed around the axis between the two poles N, S of the tubular retention portion 200.

The tubular retention portion 200 may be formed in any manner as long as the recess-protrusion portion 201 where the diameter R1 of the surrounded space 21 changes in accordance with axial-direction is positions provided. For example, circumferential-direction ends of a sheet member forming the tubular retention portion 200 are cut from a rectangular shape and the cut circumferential-direction ends are compression-bonded, to form the recess-protrusion portion 201 having a desired shape.

The present invention is not limited to the embodiments and the modifications described above, and various changes may be made without departing from the gist of the present invention.

DESCRIPTION OF THE REFERENCE CHARACTERS

1 ball for ball game
10 skin portion
11 circular pole member
12 boat-shaped member
13 internal space
14 air hole
15 closure plug
16 communication hole
20, 100, 200 tubular retention portion
21 surrounded space
30 retained object
201 recess-protrusion portion

The invention claimed is:

1. A ball for ball game, comprising:
a spherical skin portion formed to be transparent at least partially so that inside of an internal space is visible from outside;
a tubular retention portion provided in the internal space and extending so as to connect two poles of the skin portion, the tubular retention portion having a surrounded space therein; and
a retained object retained in a visible state between the two poles in the surrounded space, wherein
the tubular retention portion has a shape helically twisted between the two poles, and
the tubular retention portion is twisted with an angle not less than 135° and not greater than 270° between the two poles.

2. The ball for ball game according to claim 1, wherein
the tubular retention portion has a recess-protrusion portion where a diameter of the surrounded space changes in accordance with axial-direction positions before the tubular retention portion is twisted.

3. The ball for ball game according to claim 1, wherein
the skin portion has a communication hole through which the surrounded space of the tubular retention portion communicates with outside air, and the communication hole has a diameter smaller than an outer diameter of the retained object.

4. The ball for ball game according to claim 1, wherein
the skin portion has an air hole which is provided at a part different from the two poles and through which outside air to be introduced into the internal space and inside air to be discharged from the internal space to outside are passed, and
the ball for ball game comprises an attachable/detachable closure plug configured to close the air hole.

5. The ball for ball game according to claim 2, wherein
the skin portion has a communication hole through which the surrounded space of the tubular retention portion communicates with outside air, and
the communication hole has a diameter smaller than an outer diameter of the retained object.

6. The ball for ball game according to claim 2, wherein
the skin portion has an air hole which is provided at a part different from the two poles and through which outside air to be introduced into the internal space and inside air to be discharged from the internal space to outside are passed, and the ball for ball game comprises an attachable/detachable closure plug configured to close the air hole.

7. The ball for ball game according to claim 3, wherein the skin portion has an air hole which is provided at a part different from the two poles and through which outside air to be introduced into the internal space and inside air to be discharged from the internal space to outside are passed, and the ball for ball game comprises an attachable/detachable closure plug configured to close the air hole.

8. The ball for ball game according to claim 5, wherein the skin portion has an air hole which is provided at a part different from the two poles and through which outside air to be introduced into the internal space and inside air to be discharged from the internal space to outside are passed, and the ball for ball game comprises an attachable/detachable closure plug configured to close the air hole.

* * * * *